US005083158A

United States Patent [19]

Kashima et al.

[11] Patent Number: 5,083,158

[45] Date of Patent: Jan. 21, 1992

[54] PHOTOCONDUCTIVE CARTRIDGE HAVING SHUTTER LOCKING DEVICE FOR HOLDING OPENING OF THE CARTRIDGE IN CLOSED POSITION

[75] Inventors: Hiroyuki Kashima, Nagoya; Kiyoshi Muto, Yokkaichi; Naohisa Kinoshita, Nagoya; Toshihiro Tsuzuki, Kariya; Makoto Hasegawa, Nagoya, all of Japan

[73] Assignee: Brother Kogyo Kabushiki Kaisha, Japan

[21] Appl. No.: 597,341

[22] Filed: Oct. 15, 1990

[30] Foreign Application Priority Data

Oct. 25, 1989 [JP] Japan ..... 1-124751[U]

[51] Int. Cl.[5] ..... G03G 15/00

[52] U.S. Cl. ..... 355/200; 355/210

[58] Field of Search ..... 355/200, 202, 210, 212, 355/211, 260

[56] References Cited

U.S. PATENT DOCUMENTS 4,462,677 7/1984 Onoda .
4,470,689 9/1984 Nomura et al. ..... 355/71 X
4,708,455 11/1987 Kubota et al. ..... 355/200 X

FOREIGN PATENT DOCUMENTS 62-33581 7/1987 Japan .

*Primary Examiner*—A. T. Grimley
*Assistant Examiner*—Thu Anh Dang
*Attorney, Agent, or Firm*—Oliff & Berridge

[57] ABSTRACT

A photoconductive cartridge removably mounted on a photographic recording apparatus and including a photoconductive body, a casing having an opening for exposure of the photoconductive body to an outside of the casing, and a shutter having a closed position in which the opening is closed by the shutter and an open position in which the opening is open. The photoconductive cartridge further includes a locking device having a first engaging member movable with the shutter, a second engaging member having a first position in which the second engaging member engages the first engaging member to thereby prevent a movement of the first engaging member and a movement of the shutter from the closed position to the open position, and a second position in which the second engaging member is released from the first engaging member, and a biasing device for biasing the second engaging member toward the first position.

22 Claims, 4 Drawing Sheets

PHOTOCONDUCTIVE CARTRIDGE HAVING SHUTTER LOCKING DEVICE FOR HOLDING OPENING OF THE CARTRIDGE IN CLOSED POSITION

BACKGROUND OF THE INVENTION

1. Field of the Invention

The present invention is a photoconductive cartridge which has a photoconductive body and which is removably installed on a photographic recording apparatus.

2. Discussion of the Prior Art

A photoconductive cartridge removably installed on a photographic recording apparatus is known, for example, as disclosed in laid-open Publication No. 62-33581 of unexamined Japanese Patent Application. This photoconductive cartridge is a unit which includes a photoconductive drum as a photoconductive body, and other components such as a developing device, a cleaner, and a casing accommodating these components. The photoconductive drum cartridge is mounted on the housing body of the photographic recording apparatus. The casing of the photoconductive drum cartridge has openings through which respective circumferential portions of the photoconductive drum are exposed to the outside of the casing. The cartridge is provided with shutters each of which has a closed position for closing the appropriate opening, and an open position in which the opening is open. When the cartridge is removed from the housing body of the recording apparatus, the shutters are moved to the closed position, so that the photoconductive drum is protected against contact with any surrounding members and exposure to an ambient light.

In the photographic recording apparatus using the photoconductive drum cartridge constructed as described above, the cartridge may be replaced with a new one when the toner in the developing device is exhausted or the expected service life of the cartridge is reached. Each opening provided in the casing of the new cartridge is closed by the shutter before the cartridge is mounted on the apparatus. When the new cartridge is installed on the apparatus, the shutter is automatically operated to the open position for opening the appropriate opening. Thus, this type of photoconductive drum cartridge is protected from deterioration of the photoconductive drum due to exposure to light, and damage due to contact with the surrounding components or other objects during storage of the cartridge or during mounting of the cartridge on the apparatus. Therefore, the use of the cartridge facilitates the replacement of the exhausted components and the maintenance procedure of the photographic recording apparatus.

Some photographic recording apparatus may be adapted to selectively use photoconductive drum cartridges containing toners of different colors. Upon interchanging the cartridges for different colors, the openings formed through the casing of the cartridge of each color are closed while the cartridges are not installed in place on the recording apparatus, and while the cartridges are stored. Further, the openings are closed during maintenance operations for removing paper jammed in the apparatus, for example. In these cases, too, the photoconductive drum is protected from light exposure.

SUMMARY OF THE INVENTION

It is therefore an object of the present invention to provide a photoconductive cartridge for a photographic recording apparatus, which includes means for locking the shutter in the closed position to thereby protect the photoconductive body, when the cartridge is removed from the recording apparatus.

The above object may be attained according to the principle of the present invention, which provides a photoconductive cartridge removably mounted on a photographic recording apparatus, the cartridge comprising (a) a photoconductive body, (b) a casing having an opening for exposure of the photoconductive body to an outside of the casing, (c) a shutter having a closed position in which the opening is closed by the shutter and an open position in which the opening is open, and (d) a locking device which includes a first engaging member movable with the shutter, a second engaging member having a first position in which the second engaging member engages the first engaging member to thereby prevent a movement of the first engaging member and a movement of the shutter from the closed position to the open position, and a second position in which the second engaging member is released from the first engaging member, and biasing means for biasing the second engaging member toward the first position.

When the photoconductive cartridge is removed from the photographic recording apparatus, the shutter is maintained in the closed position by the locking device, whereby the opening of the cartridge is closed to protect the photoconductive member. More specifically, the second engaging member is held in the first position for engagement with the first engaging member under the biasing action of the biasing means, to thereby prevent the shutter from moving from the closed position toward the open position. Thus, the locking device is placed in the operating position for locking the shutter in the closed position while the cartridge is removed from the recording apparatus.

When the cartridge is mounted on the recording apparatus, the locking device may be automatically brought to a non-operating position against the biasing force of the biasing means. Namely, the recording apparatus may be provided with suitable actuator means for moving the second engaging member to the second position against the biasing action of the biasing means, and suitable means for subsequently moving the shutter to the open position together with the first engaging member. In this open position of the shutter, the photoconductive body is partially exposed to the outside of the casing through the opening.

The locking device may be adapted to permit the shutter to be moved from the closed position to the open position against the biasing action of the biasing means, even after the photoconductive cartridge is removed from the recording apparatus. For example, the shutter may be moved to the open position by applying a force to the shutter or first engaging member to move the second engaging member to the second position against the biasing force of the biasing means. Alternatively, the shutter may be moved to the open position after the second engaging means is released from the first engaging means by applying a force to the second engaging member to move the same to the second position against the biasing force of the biasing means.

As described above, the present photoconductive cartridge removed from the recording apparatus is suitably protected from unexpected movement of the shutter to the open position and consequent exposure of the photoconductive body to the ambient light or damage due to contact with the surrounding objects.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
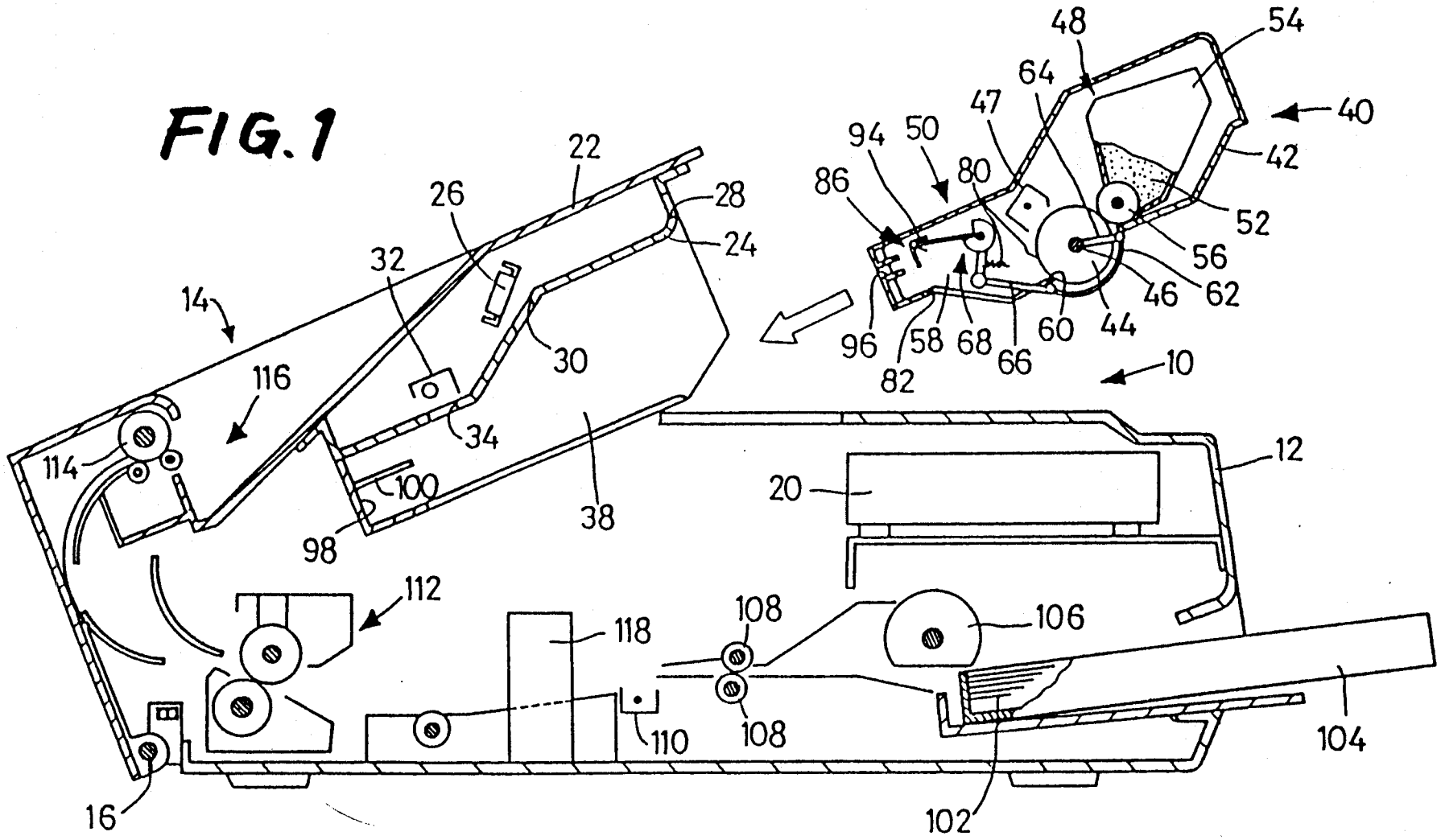
FIG. 1 is a front elevational view in cross section of a laser printer incorporating one embodiment of a photoconductive cartridge of the present invention.

Referring first to FIG. 1, reference numeral 10 denotes a laser printer as a photographic recording apparatus incorporating a photoconductive drum cartridge generally indicated at 40. The laser printer 10 has a housing body 12, and a cover 14 which is pivotally mounted on the housing body 12 such that the cover 14 is pivotable about a pivot axis 16 at one end of the housing body 12, between a closed position and an open position (position of FIG. 1).

The housing body 12 accommodates in an upper portion thereof a laser scanner unit 20 which accommodates a semi-conductor laser source, a collimator lens, a polygon mirror and other elements. The cover 14 includes a top plate 22 which is provided with an enclosure 24 accommodating a reflecting mirror 26. A light beam produced by the laser scanner unit 20 is incident upon the reflecting mirror 26 through an aperture 28 formed through the enclosure 24. The light beam reflected by the reflecting mirror 26 is passed through another aperture 30 also formed through the enclosure 24, so that the reflected light beam is directed toward a cylindrical photoconductive drum 44 of the photoconductive drum cartridge 40 (which will be described). A pre-exposing lamp 32 is provided so as to extend between opposite front and rear walls of the enclosure 24, so that a light beam produced by the lamp 32 is incident upon the photoconductive drum, through an aperture 34 formed through the enclosure 24.

The top plate 22 of the cover 14 is also formed with a cartridge receiver 38 located below the enclosure 24. This receiver 38 is adapted to receive the photoconductive drum cartridge 40. The cartridge 40 has a casing 42 whose lower central portion supports a photoconductive member in the form of the photoconductive drum 44, such that the drum 44 is rotatable about a shaft portion 46 thereof. A charger 47 is disposed generally above the photoconductive drum 44, and a developing section 48 and a cleaning section 50 are disposed on opposite sides of the drum 44 and the charger 47. The developing section 48 includes a toner storage container 54 for storing a toner 52, and a developing roll 56 adjacent to the circumference of the drum 44. The cleaning section 50 has a housing 58 which accommodates a cleaner adjacent to the circumference of the drum 44, and a guide vane adjacent to the cleaner.

The casing 42 has an image transfer opening 60 through which a portion of the circumference of the photoconductive drum 44 is exposed to the outside of the casing 42, so that a pattern of image formed by the toner 52 is transferred to a recording sheet 102 (which will be described). This image transfer opening 60 is closed and opened by a shutter 62 which is shown in enlargement in FIGS. 2 and 3.

Figure 2:
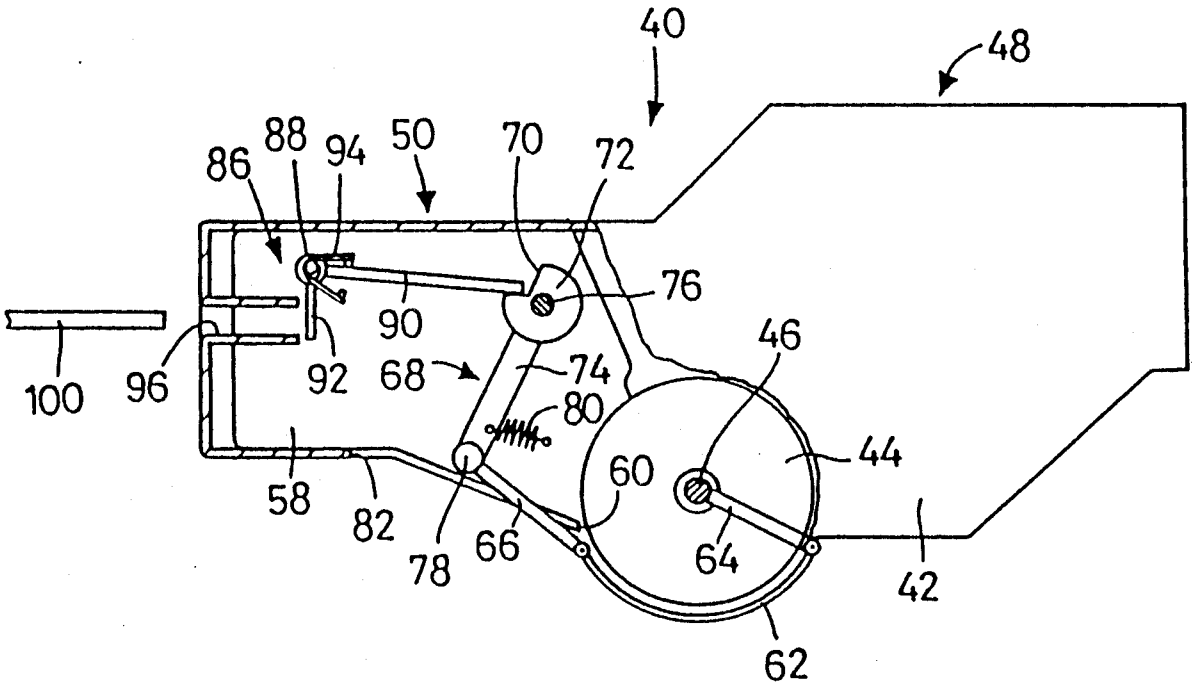
FIG. 2 is a front elevational view partly in cross section of the photoconductive drum cartridge of FIG. 1, when a shutter is in a closed position.

The shutter 62 takes the form of a part-circumferential or arcuate shape following the lower portion of the circumference of the photoconductive drum 44. The shutter 62 has a closed position for closing the opening 60 and thereby covering the corresponding portion of the circumferential surface of the drum 44, as indicated in FIG. 2. A pair of first links 64 are disposed at respective longitudinal opposite ends of the photoconductive drum 44 such that each first link 64 is connected to the appropriate end of the shaft portion 46, pivotally about the shaft portion 46. The other end of each first link 64 is connected pivotally to one end of the shutter 62. The other end of the shutter 62 is connected pivotally to one end of each of a pair of second links 66. These second links 66 are disposed adjacent to the front and rear walls of the housing 58 of the cleaning section 50. The other end of each second link 66 is non-pivotally fixed to one end of a corresponding one of a pair of first engaging members 68. Each of the first engaging members 68 includes a disk-like head portion 72 having a recess in the form of a sectorial cutout 70 open in a part of the circumference thereof, and an arm portion 74 which extends from the circumference of the disk of the head portion 72. The head portion 72 is supported by the housing 58, pivotally about a support shaft 76, together with the arm portion 74. The arm portion 74 of each first engaging member 68 has a free end at which the second link 66 is secured.

When the shutter 62 is in the closed position, the first engaging members 68 are placed in the position indicated in FIG. 2. When the shutter 62 is moved to an open position of FIG. 3, the shutter 62 is moved with the pair of second links 66, such that the first engaging members 68 are pivoted about the support shaft 76. The arm portion 74 of each first engaging member 68 is biased by a tensile coil spring 80 fixed to the housing 58, so that the shutter 62 is normally maintained in the closed position of FIG. 2. The closed position is defined by abutting contact of the appropriate end of the shutter 62 with the casing 42, as indicated in FIG. 2.

The casing 42 of the photoconductive drum cartridge 40 has a pair of apertures 82 adjacent to the opposite longitudinal end portions of the drum 44. These apertures 82 permit the second links 66 to be moved therethrough when the shutter 62 is moved between the closed and open positions of FIGS. 2 and 3. The casing 42 further has openings through which the photoconductive drum 44 is exposed to the light beams from the pre-exposing lamp 32 and the laser scanner unit 20.

A pair of second engaging members 86 are disposed on the front and rear walls of the housing 58 of the cleaning section 50. Each second engaging member 86 includes a proximal portion 88 pivotally attached to the housing 58, a first arm 90 which extends from the proximal portion 88 toward the head portion 72 of the corresponding first engaging member 68, for engagement with the sectorial cutout 70, and a second arm 92 which extends from the proximal portion 88 and cooperates with the first arm 90 to form a suitable angle therebetween. The proximal portion 88 is provided with a torsion spring 94 such that one end of the spring 94 engages the first arm 90 while the other end engages the housing 58. The torsion spring 94 biases each second engaging member 86 such that the first arm 90 is normally held in engagement with the cutout 70 of the corresponding first engaging member 68. More specifically, the end portion of the first arm 90 is forced by the torsion spring 94 against one of two surfaces which defines the sectorial cutout 70.

In the arrangement described above, the first arms 90 of the second engaging members 86 are held in engagement with the cutouts 70 of the first engaging members 68 under the biasing forces of the torsion springs 94, whereby the shutter 62 is maintained in its closed position of FIG. 2 under the biasing actions of the torsion springs 94 and tensile coil springs 80. In other words, the first and second engaging members 68, 86 and the torsion springs 94 provide a locking device for holding the shutter 62 in the closed position.

Figure 3:
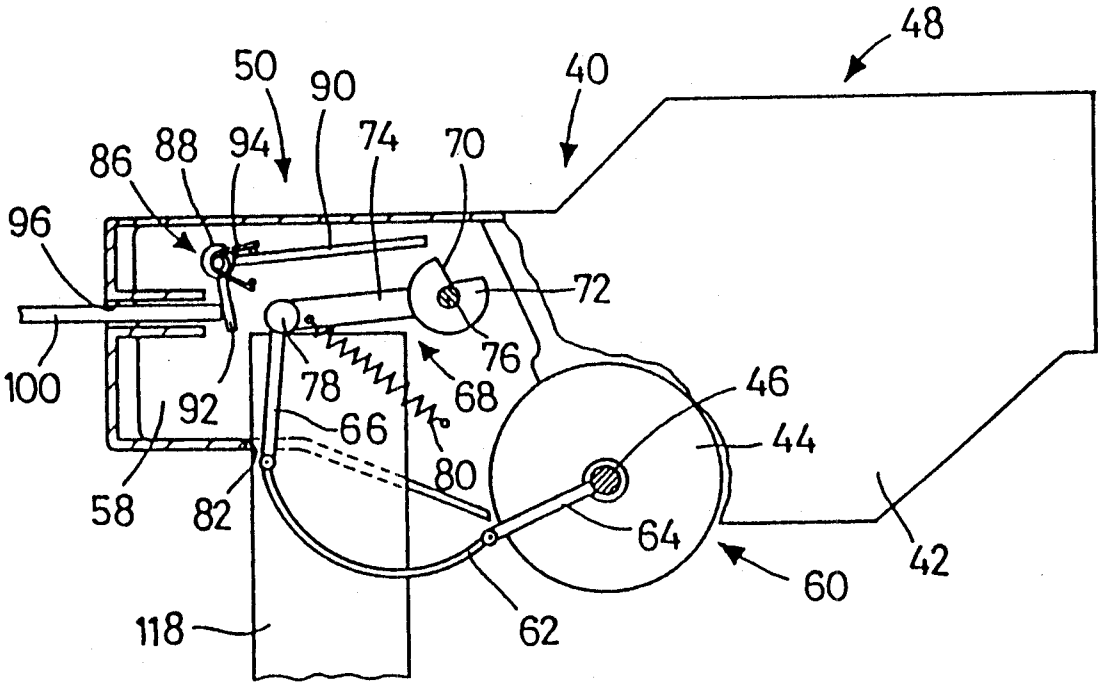
FIG. 3 is a view similar to that of FIG. 2, indicating the shutter when placed in an open position.

The casing 42 of the photoconductive drum cartridge 40 has a pair of holes 96 which are aligned with the second arms 92 of the second engaging members 86 disposed on the front and rear walls of the housing 58. The holes 96 extend toward the second arms 92, such that the inner ends of the holes 96 are spaced a short distance from the second arms 92. The holes 96 are adapted to receive respective actuating projections 100 formed on a side wall 98 of the cartridge receiver 38, when the cartridge 40 is received in the cartridge receiver 38, as indicated in FIG. 3.

The laser printer 10 has various components accommodated in the housing body 12. These components include a sheet cassette 104 for storing a stack of recording sheets 102, a pick-up roll 106 for delivering the sheets 102 one after another, a pair of registering rolls 108, an image transfer charger 110, an image fixing device 112, and an ejector roll 114, which are arranged from right to left as seen in FIG. 1. The recording sheet 102 is fed to a tray 116 through the components indicated above. The housing body 12 further accommodates a control device in a lower portion thereof. The control device includes a printed circuit board, and stores various control programs for controlling a printing operation of the laser printer 10.

A pair of actuating members 118 are provided so as to extend from the bottom wall of the housing body 12, toward the cartridge receiver 38, so that these actuating members 118 pass through the corresponding apertures 82 formed through the casing 42 of the photoconductive drum cartridge 40, when the cartridge 40 is received in the cartridge receiver 38.

Before the photoconductive drum cartridge 40 is installed on the laser printer 10, the shutter 62 is locked in the closed position of FIG. 2 by the locking device 68, 86, 94. When the cartridge 40 is installed, the cover 14 is first pivoted in the upward direction, and the cartridge 40 is inserted into the cartridge receiver 38, as indicated by an arrow indicated in FIG. 1, while the shutter 62 is maintained in the closed position. As the leading end of the cartridge 40 is moved toward actuating projections 100 of the cartridge receiver 38, the projections 100 are inserted into the holes 96 and eventually come into abutting contact with the second arms 92 of the second engaging members 86. Consequently, the second engaging members 86 are pivoted against the biasing actions of the torsion springs 94, thereby releasing the first arms 90 from the cutouts 70 of the head portions 72 of the first engaging members 68. Thus, the shutter 62 is unlocked from the closed position. The cartridge 40 is locked in the cartridge receiver 38 by a suitable latch.

Then, the cover 14 is pivoted downwards, with the cartridge 40 moved toward the actuating members 118. As a result, the actuating members 118 pass through the respective apertures 82 formed through the casing 42 of the cartridge 40, and the upper end faces of the members 118 come into abutting contact with the free ends 78 of the arms 74 of the first engaging members 68, whereby the arms 74 are pivoted upwards about the support shaft 76, against the biasing actions of the tensile coil springs 80. Consequently, the first and second links 64, 66 are pivoted about the respective ends of the shutter 62, so as to move the shutter 62 to the open position of FIG. 3 in which the image transfer opening 60 is opened so that the appropriate circumferential portion of the photoconductive drum 44 is exposed to the outside of the casing 42, facing the image transfer charger 110.

In a printing operation, the photoconductive drum 44 is subjected to a pre-exposing operation by exposure to the light beam from the pre-exposing lamp 32, and is evenly charged by the charger 47. Then, the drum 44 is subjected to an image forming exposing operation by a laser beam from the laser scanner unit 20 and reflecting mirror 26, whereby a latent image corresponding to the original image represented by the laser beam is formed on the surface of the photoconductive drum 44. Then, the latent image is developed by the developing section 48, such that the toner 52 is deposited on the selected local areas of the drum surface, in the image pattern. In the meantime, the recording cut sheet 102 is delivered from the sheet cassette 104 by the pick-up roll 106, and fed through a clearance between the drum 44 and the image transfer charger 110, via the registering rolls 108, so that the visible image formed by the pattern of the toner 52 is transferred from the drum 44 onto the sheet 102. The transferred visible image (toner 52) is fixed by the image fixing device 112, and ejected onto the tray 116 by the ejector rolls 114. After the toner 52 is transferred to the sheet 102, the surface of the photoconductive drum 44 is wiped by the cleaning portion 50, to remove the residual mass of the toner.

When the photoconductive drum cartridge 40 is removed from the laser printer 10, the cover 14 is initially pivoted upwards, with the second engaging members 86 released from the actuating members 118 whereby the first engaging members 68 are returned to the position of FIG. 2 by the biasing forces of the tensile coil springs 80, and the shutter 62 is returned to the closed position of FIG. 2 for protecting the photoconductive drum 44. Then, the latch for locking the cartridge 40 in the receiver 38 is released, and the cartridge 40 is pulled out of the receiver 38. As a result, the actuating projections 100 are pulled out of the holes 96, whereby the first arms 90 are brought into engagement with the cutouts 70 under the biasing actions of the torsion springs 94. Thus, the locking device 68, 86, 94 is placed in the operating position for locking the shutter 62 in the closed position of FIG. 2.

As described above, the shutter 62 is automatically returned to the closed position and locked in this closed position by the locking device 68, 86, 94, when the cartridge 40 is removed from the laser printer 10. In this condition, the shutter 62 is protected from unexpected movement to the open position which may cause structural deterioration or surface damage of the drum 44.

When it becomes necessary to open the opening 60 after the cartridge 40 is removed, the shutter 62 may be moved to the open position by the user of the printer 10, against the biasing forces of the coil and torsion springs 80, 94. In this case, the pivotal movement of the first engaging member 68 toward the position of FIG. 3 causes the first arm 90 to be pushed up by the surface of the sectorial cutout 70 against which the arm 90 is forced by the torsion spring 94.

Figure 4:
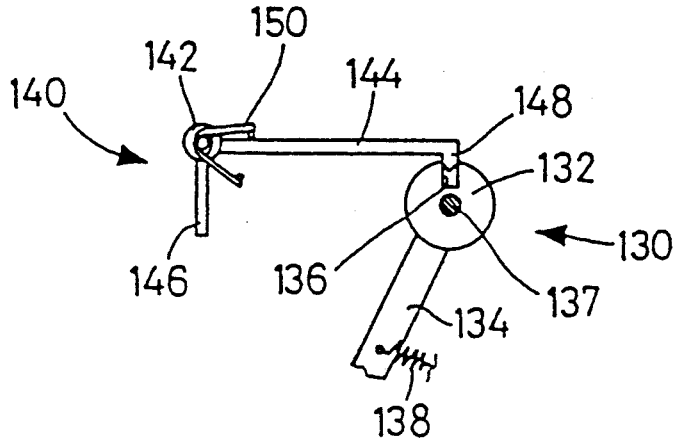
FIG. 4 is a fragmentary front elevational view of another embodiment of the photoconductive drum cartridge of the present invention, when the shutter is in a closed position.
Figure 5:
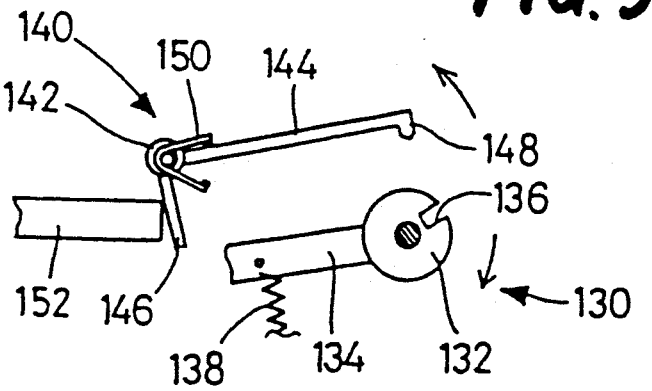
FIG. 5 is a view similar to that of FIG. 4, showing the shutter when placed in an open position.

Referring next to FIGS. 4 and 5, there will be described a modified embodiment of the present invention. For the interest of brevity and simplification, only the modified part of this second embodiment will be described.

In the present modified embodiment, each first engaging member 130 includes a head portion 132 and an arm portion 134. The head portion 132 has a recess in the form of a rectangular radial cutout 136 formed in the radial direction thereof, and is supported by the housing 58 of the cartridge 40, pivotally about a support shaft 137. A tensile coil spring 138 is disposed between the arm portion 134 and the housing 58, so that the shutter 62 and the first engaging member 130 are normally placed in the closed position and in the position of FIG. 4, respectively.

On the other hand, each second engaging member 140 includes a proximal portion 142, a first arm 144 extending from the proximal portion 142 toward the first engaging member 130, and a second arm 146 which extending from the proximal portion 142 and cooperates with the first arm 144 to form a suitable angle therebetween. The second engaging member 140 is pivotally supported at its proximal portion 142 by the housing 58. As shown in FIG. 5, the first arm 144 has an engaging tab 148 engageable with the radial cutout 136 of the head portion 132 of the first engaging member 130. When the shutter 62 is placed in the closed position, the engaging tab 148 is held engaged with the cutout 136 under the biasing force of the torsion spring 150. In the present embodiment, the first and second engaging members 130, 140 and the torsion springs 150 cooperate to provide a locking device for holding the shutter 62 in the closed position.

Once the locking device 130, 140, 150 is placed in the operating position in which the engaging tabs 148 engage the cutouts 136, the shutter 62 will not be moved to the open position, even when a relative large force is exerted on the shutter 62. This embodiment assures improved reliability of the locking device.

To move the shutter 62 to the open position in the above embodiment, an actuating rod as indicated at 152 in FIG. 5 is inserted by the user into each hole 96 of the casing 42 of the cartridge 40, for pivoting the second engaging members 140 against the biasing forces of the torsion springs 150 and thereby releasing the engaging tabs 148 from the radial cutouts 136.

While the two presently preferred embodiments of the present invention have been described above, the present invention may apply to a photoconductive cartridge which includes a photoconductive belt or any photoconductive body other than the photoconductive drum 44 provided in the illustrated embodiments. In the illustrated embodiments, the cartridge 40 incorporates the developing and cleaning sections 48, 50. However, the principle of the present invention is applicable to any photoconductive cartridge which incorporates at least a photoconductive body.

It is to be understood that the present invention may be embodied with various other changes, modifications and improvements, which may occur to those skilled in the art. For example, the first and second engaging members and the biasing means for these engaging members, and the link mechanism for moving the shutter 62 between the closed and open positions may be suitably modified, provided that the modifications do not depart from the spirit and scope of the invention defined in the following claims.

What is claimed is:

1. A photoconductive cartridge removably mounted on a photographic recording apparatus, comprising:
   - a photoconductive body;
   - a casing having an opening for exposure of the photoconductive body to an outside of the casing;
   - a shutter having a closed position in which the opening is closed by the shutter and an open position in which the opening is open; and
   - a locking device including a first engaging member movable with said shutter, a second engaging member having a first position in which said second engaging member engages said first engaging member to thereby prevent a movement of said first engaging member and a movement of said shutter from said closed position to said open position, and a second position in which said second engaging member is released from said first engaging member, and biasing means for biasing said second engaging member toward said first position.

2. A photoconductive cartridge according to claim 1, further comprising a link mechanism connecting said first engaging member and said shutter.

3. A photoconductive cartridge according to claim 1, wherein said photoconductive body is a rotary photoconductive body supported by said casing rotatably about an axis thereof.

4. A photoconductive cartridge according to claim 3, wherein said rotary photoconductive body is a cylindrical photoconductive drum rotatable about said axis.

5. A photoconductive cartridge according to claim 3, further comprising a link mechanism which connects said first engaging member and said shutter such that said link mechanism is movable with said first engaging member and said shutter.

6. A photoconductive cartridge according to claim 5, wherein said link mechanism comprises a first link pivotally connected at one end thereof to one portion of said shutter and supported at the other end thereof pivotally about said axis of said rotary photoconductive body, and a second link pivotally connected at one end thereof to the other end of said shutter and fixed at another portion thereof to said first engaging member such that said second link and said first engaging member are pivotable about an axis.

7. A photoconductive cartridge according to claim 1, wherein said first engaging member comprises a head portion supported by said casing rotatably about an axis thereof, and an arm portion extending from said head portion and connected to said shutter, said head portion having a recess engageable with said second engaging member.

8. A photoconductive cartridge according to claim 7, wherein said first engaging member is pivotable about said axis of said head portion, between a first position in which said first engaging member engages said second engaging member placed in said first position and holds said shutter in said closed position, and a second position in which said first engaging member is released from said second engaging member and holds said shutter in said open position.

9. A photoconductive cartridge according to claim 8, further comprising means for biasing said first engaging member toward said first position.

10. A photoconductive cartridge according to claim 8, wherein said second engaging member comprises an arm supported by said casing pivotally about one end thereof and engageable at the other end thereof with said recess of said head portion of said first engaging member, said arm being pivotable between said first and second positions of said second engaging member.

11. A photoconductive cartridge according to claim 10, wherein said head portion of said first engaging member consists of a disk-like member having said recess in the form of a sectorial cutout open in a part of a circumference thereof, said other end of said arm of said second engaging member being forced by said biasing means against one of two surfaces of said disk-like member which define said sectorial cutout, whereby said second engaging member is held in said first position thereof.

12. A photoconductive cartridge according to claim 10, wherein said head portion of said first engaging member consists of a disk-like member having said recess formed in a radial direction thereof and open in a part of a circumference thereof, said arm of said second engaging member having at said other end thereof a tab which engages said recess under a biasing action of said biasing means, whereby said second engaging member is held in said first position thereof.

13. A photoconductive cartridge according to claim 1, wherein said first and second engaging members engage each other so as to permit the movement of said shutter to said open position, if a force larger than a force of said second engaging member which acts on said first engaging member under a biasing action of said biasing means is applied to said first engaging member.

14. A photoconductive cartridge according to claim 1, wherein said first and second engaging members engage each other so as to prevent the movement of said shutter to said open position, even if a force larger than a force of said second engaging member which acts on said first engaging member under a biasing force of said biasing means is applied to said first engaging member.

15. A photoconductive cartridge according to claim 1, wherein said casing has a hole adjacent to said second engaging member, said hole permitting an actuating member of said recording apparatus to be inserted therethrough to act on said second engaging member for moving said second engaging member from said first position toward said second position against a biasing force of said biasing means of said locking device.

16. A photoconductive cartridge according to claim 1, further comprising another biasing means for biasing said first engaging member toward a position thereof corresponding to said closed position of said shutter.

17. A photoconductive cartridge according to claim 16, wherein said casing has an aperture which permits an actuating member of said recording apparatus to pass therethrough to act on said first engaging member for moving said first engaging member from said position corresponding to said closed position of said shutter to a position thereof corresponding to said open position of said shutter.

18. A photographic recording apparatus comprising the photoconductive cartridge as set forth in claim 1.

19. A photographic recording apparatus according to claim 18, further comprising a cartridge receiver which is movable between a first position for permitting said photoconductive cartridge to be inserted into said cartridge receiver, and a second position in which said photoconductive cartridge received in said cartridge receiver is in an operating position.

20. A photographic recording apparatus according to claim 19, wherein said cartridge receiver includes an actuating member for moving said second engaging member from said first position to said second position against a biasing force of said biasing means of said locking device, when said photoconductive cartridge is inserted into said cartridge receiver.

21. A photographic recording apparatus according to claim 19, further comprising an actuating member for moving said first engaging member from a position thereof corresponding to said closed position of said shutter to a position thereof corresponding to said open position of said shutter, when said cartridge receiver is moved from said first position to said second position.

22. A photographic recording apparatus according to claim 19, further comprising a pivotable cover having a top plate portion, said cartridge receiver is supported by said top plate portion such that said cartridge receiver is moved between said first and second positions thereof when said pivotable cover is pivoted.

* * * * *